US007062809B2

(12) United States Patent
Sheffield

(10) Patent No.: US 7,062,809 B2
(45) Date of Patent: Jun. 20, 2006

(54) MAGNETIC ROOFING HATCHET

(76) Inventor: James M. Sheffield, 325 Hemlock Dr., Grand Prairie, TX (US) 75052

( * ) Notice: Subject to any disclaimer, the term of this patent is extended or adjusted under 35 U.S.C. 154(b) by 0 days.

(21) Appl. No.: 10/728,877

(22) Filed: Dec. 8, 2003

(65) Prior Publication Data

US 2005/0120488 A1 Jun. 9, 2005

(51) Int. Cl.
*B25D 1/04* (2006.01)

(52) U.S. Cl. ..... 7/145; 7/144

(58) Field of Classification Search ..... 7/122, 7/144, 145; 81/24

See application file for complete search history.

(56) References Cited

U.S. PATENT DOCUMENTS

| | | | | |
|---|---|---|---|---|
| 29,760 | A | 8/1860 | Boeklen | |
| 1,168,890 | A * | 1/1916 | Koehler | 7/122 |
| 1,174,120 | A * | 3/1916 | Chaffin | 7/122 |
| 2,500,629 | A * | 3/1950 | Crookston | 7/122 |
| 2,596,558 | A * | 5/1952 | Ingram | 7/122 |
| 2,671,483 | A * | 3/1954 | Clark | 81/24 |
| 2,821,222 | A | 1/1958 | Mount | |
| 3,233,643 | A | 2/1966 | Reuterfors | |
| 3,257,671 | A | 6/1966 | Crookston | |
| 3,599,255 | A * | 8/1971 | Carroll, Sr. | 7/145 |
| 4,073,327 | A | 2/1978 | Pearson | |
| 4,291,736 | A | 9/1981 | Robertson et al. | |
| 4,465,115 | A | 8/1984 | Palomera | |
| 6,266,834 | B1 * | 7/2001 | Walsh et al. | 7/144 |
| 2003/0140734 | A1 * | 7/2003 | Tovar | 81/24 |

* cited by examiner

*Primary Examiner*—Lee D. Wilson
(74) *Attorney, Agent, or Firm*—Siemens Patent Services, LC

(57) ABSTRACT

A roofing hatchet having a magnetic striking face is hereby disclosed. A unique shouldered cap housing the magnet dampens the forces transferred from the striking by transferring the force directly to the hatchet head, bypassing the magnet, thereby preventing demagnetization typically caused by such repeated linear forces. Additional features include a cutting blade housing adapted to adjustably receive a variety of different commercially available utility knife blades, an adjustable gauge for gauging a distance from the bitted end of the hatchet, and a pulling notch for pulling fasteners from a surface. Unlike prior art hatchets, the handle of the inventive hatchet is angled, relative to the striking face, such that the force transfer from the hand of a user to a fastener being driven into a sloping surface is optimized.

9 Claims, 6 Drawing Sheets

MAGNETIC ROOFING HATCHET

BACKGROUND OF THE INVENTION

1. Field of the Invention

The present invention relates to hand held and operated hammers, as are used in the construction trades. More particularly, the invention comprises a roofing hatchet having a magnetic head which is used to hold ferrous fasteners, or nails, in position for driving without the need of the user holding the nail with his free hand, thereby freeing the second hand for other tasks involved in the roofing process.

2. Description of the Prior Art

While numerous examples of magnetic hammers may be found in the prior art, none provide magnetic attraction of a nail while protecting the magnet from the forces of hammering a nail. Magnets, by nature, are brittle and prone to shattering and demagnetizing, and must be protected from the force of the hammer's blows.

The earliest magnetic hammer, U.S. Pat. No. 29,760, issued to Reinhold Boeklen on Aug. 24, 1860, presents a tack hammer with a first end magnetized by rubbing it with a loadstone and a second, non-magnetized end for driving the nail once it is set.

U.S. Pat. No. 4,465,115, issued to Louis M. Palomera on Aug. 14, 1984, discloses a HAMMERHEAD. A magnet recessed into the face of the hammerhead, proximate the end of the handle, holds a nail by the side of its shank, parallel to the hammerhead, substantially normal to the striking face of the hammerhead. By contrast, the present invention teaches a magnet within the striking face, which holds the head of a nail.

A MAGNETIC HAMMER is disclosed in U.S. Pat. No. 4,291,736, issued to Alan D. Robertson, et al., on Sep. 29, 1981. A cylindrical magnet retainer attached to the striking face of a hammer head by a threaded shaft. A cylindrical magnet is retained within the magnet retainer. While the present invention includes a protective cover to prevent the magnet from physically striking the head of a nail being driven, Robertson provides no such protection.

U.S. Pat. No. 4,073,327, issued Ottis D. Pearson on Feb. 14, 1978, for a MAGNETIC HEAD HAMMER discloses a hardened steel magnet incorporated into the striking face of a hammer head. Like Robertson, Pearson provides no protective shield over the magnet for shielding it from physically striking the nail head.

A SHINGLING TOOL WITH ADJUSTABLE GUIDE is disclosed by J. R. Crookston in U.S. Pat. No. 3,257,671, issued on Jun. 28, 1966. A hatchet type head is disclosed, with a slidably adjustable spacing gauge proximate an upper edge and the blade edge of the head. A cutting blade is held in place proximate the lower edge and blade edge of the hatchet by a metal plate held in place by a pair of screws. The SHINGLING TOOL of Crookston has no magnetic head, as in the present invention. Furthermore, Crookston requires a specific cutting blade, while the present invention is adapted to receive a variety of more commonly available blade.

Aldor S. E. Reuterfors discloses a SHINGLING HATCHET in U.S. Pat. No. 3,233,643, issued on Feb. 8, 1966. The hatchet of Reuterfors incorporates a cutting device specifically designed as a part of the hatchet, as opposed to the blade of the present invention, which is commonly available through normal retail sources.

In U.S. Pat. No. 2,821,222, issued to George W. Mount on Apr. 13, 1953, discloses a MAGNETIC HAMMER AND METHOD FOR MAKING SAME, hammer having two striking faces is disclosed. A first head incorporates a magnet for holding a nail for an initial strike which sets the nail into a surface, and a second head is used for driving the nail into the surface. Unlike the present invention, Mount's hammer must be rotated about its handle in the process of setting and driving the nail.

None of the above inventions and patents, taken either singly or in combination, is seen to describe the instant invention as claimed.

SUMMARY OF THE INVENTION

The present invention consists of a roofing hatchet with improvements on the typical elements of existing roofing hatchets, including a spacing guide and cutting edge, with the addition of a magnetic head for holding nails to facilitate starting the driving of the nail. More particularly, the invention comprises a roofing hatchet having a magnetic striking surface within the head which is used to hold ferrous fasteners, or nails, in position for driving, without the need of the user holding the nail with his free hand, thereby freeing the second hand for other tasks involved in the roofing process. The striking surface is uniquely designed to protect the magnet from the direct impact of the striking blows, thereby protecting against shattering and demagnetization of the magnet.

In the roofing industry, a hatchet type tool is often used, as a single tool that may be used to both install and remove shingles.

Prior art hatchets have had a number of limitations, however.

Firstly, a magnetic head to aid in starting a fastener has not been available. The force of repeatedly striking tends to demagnetize a magnet, hence magnetic heads have commonly been found only in light use tools.

Secondly, prior art hatchets having cutting blades attached have tended to be designed for specific blades, for which replacement blades may not be readily available.

Thirdly, in most prior art hatchets, the handle tends to be attached such that it is parallel to the striking face of the hatchet. This arrangement tends to cause the strike face of the hatchet to strike the fastener obliquely when working on a sloped roof surface, thereby reducing the strike force and causing bent or ricocheting fasteners and causing uneven wear of the striking face.

Accordingly, it is a principal object of the invention is to provide a roofing hatchet having a magnetic striking surface within the head for starting a roofing fastener.

It is another object of the invention to provide a roofing hatchet with a magnetic striking surface that automatically centers a fastener on the head.

It is a further object of the invention to provide a roofing hatchet with a cutting blade housing adapted to receive a variety of different utility blades, which are commonly available, with equal effectiveness.

Still another object of the invention is to provide a roofing hatchet with a handle configured and angled to provide optimal striking force to a roofing fastener.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

As illustrated by FIGS. 1 thru 5, the roofing hatchet 1 of the present invention consist of a head 100 and a handle 200. The head 100 is typically formed of a hard metal, such as, but not limited to, steel, and the handle of a wood, polymer or fiberglass.

Figure 1:
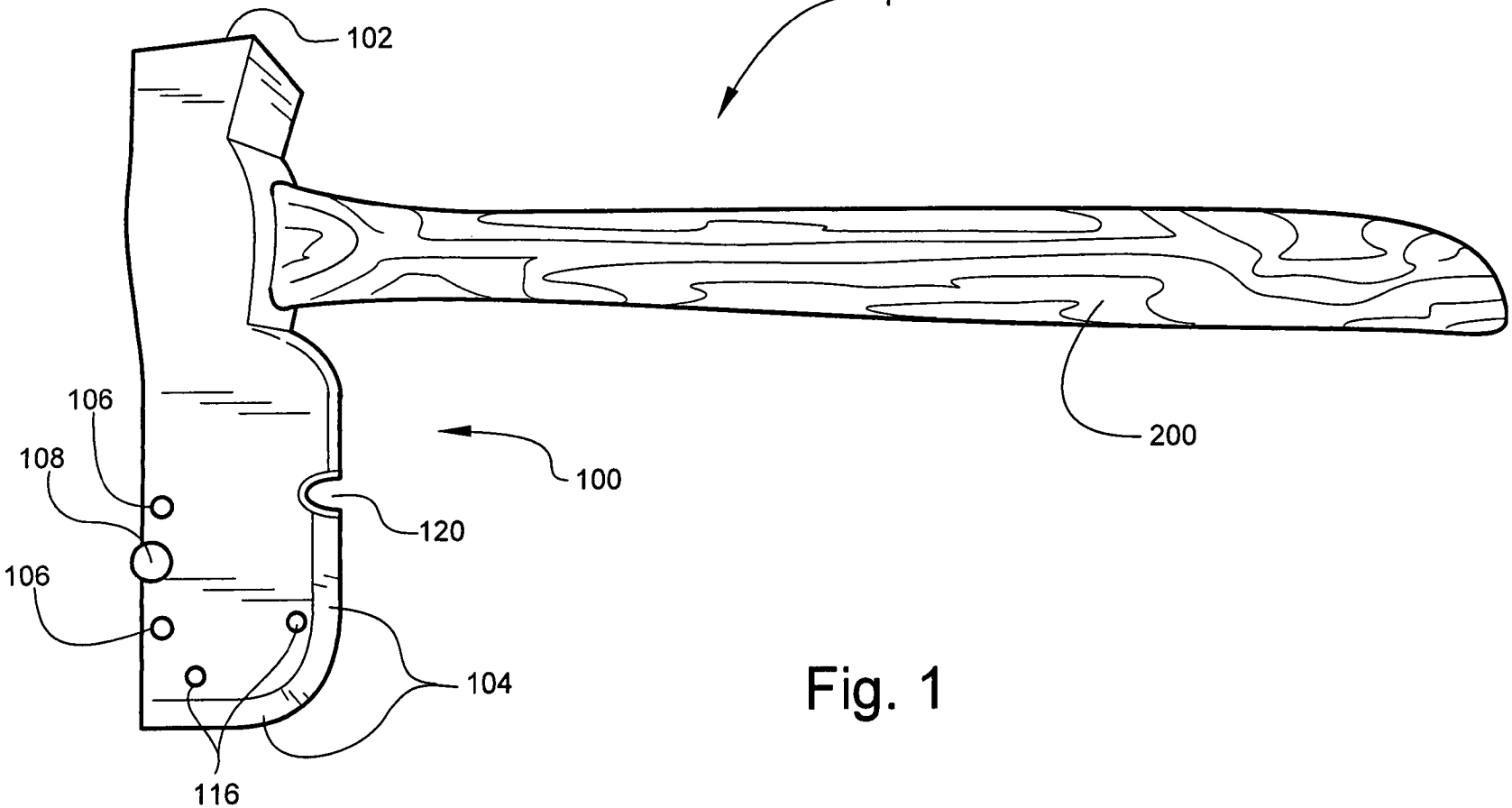
FIG. 1 is a left side view of the roofing hatchet of the present invention.
Figure 2:
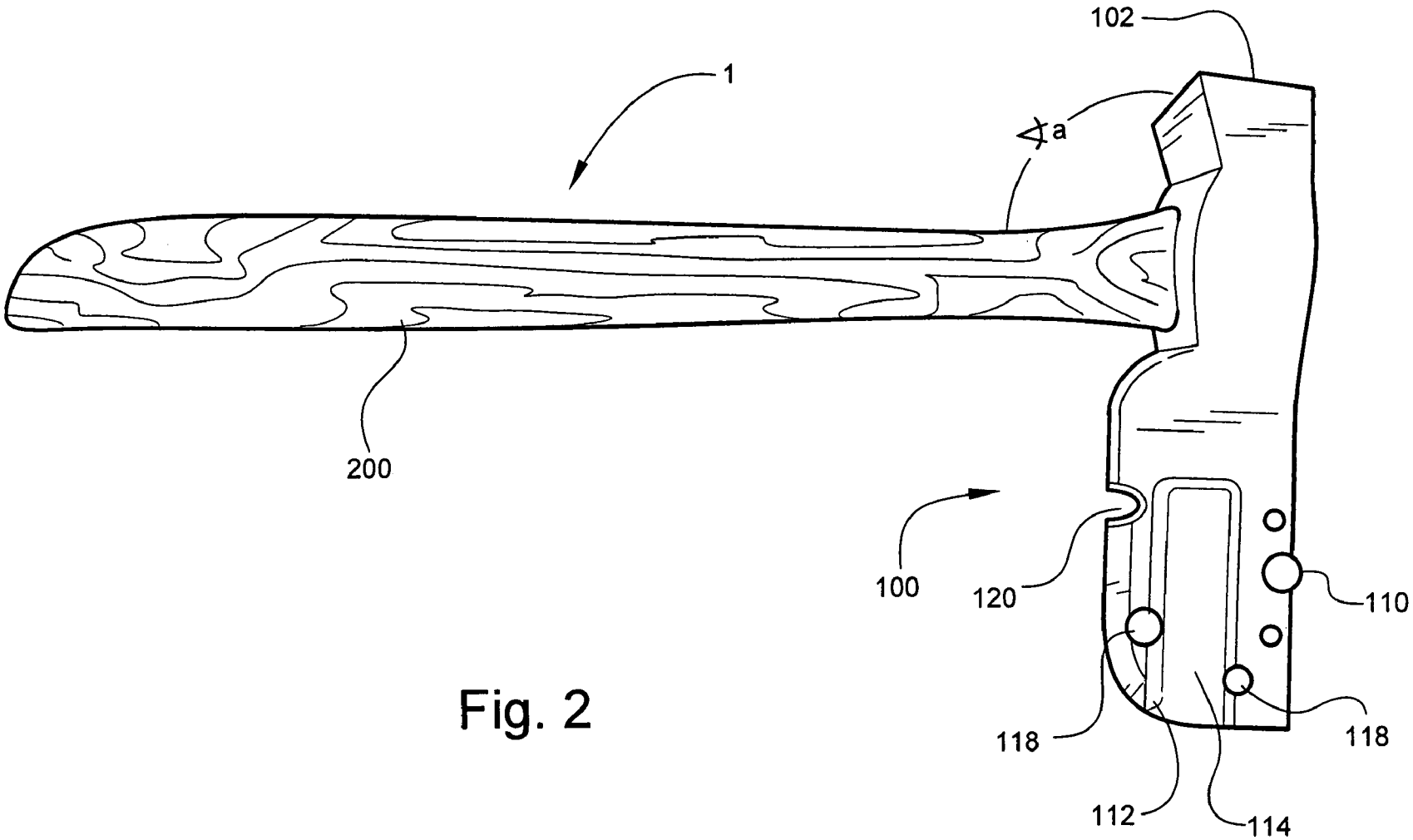
FIG. 2 is a right side view of the roofing hatchet of the present invention.
Figure 4:
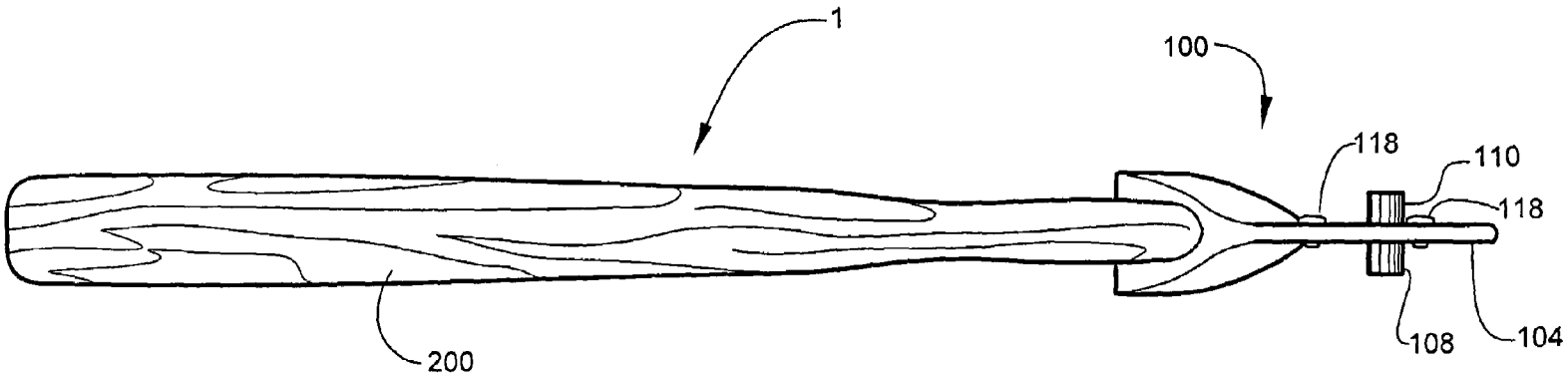
FIG. 4 is a bottom view of the roofing hatchet of the present invention, showing the bitted edge of the hatchet.
Figure 3:
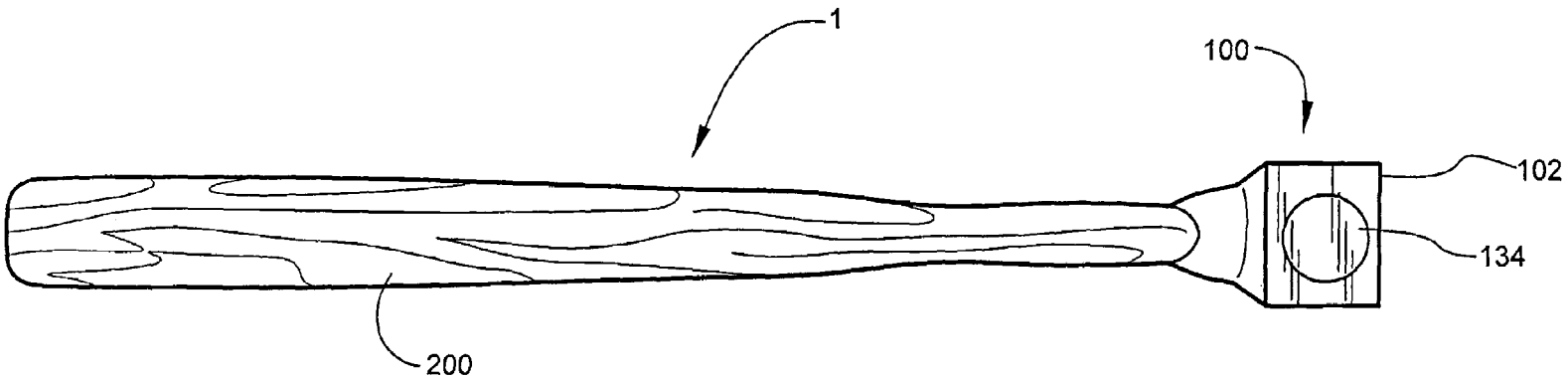
FIG. 3 is a top view of the roofing hatchet of the present invention, showing the striking face of the hatchet.
Figure 5:
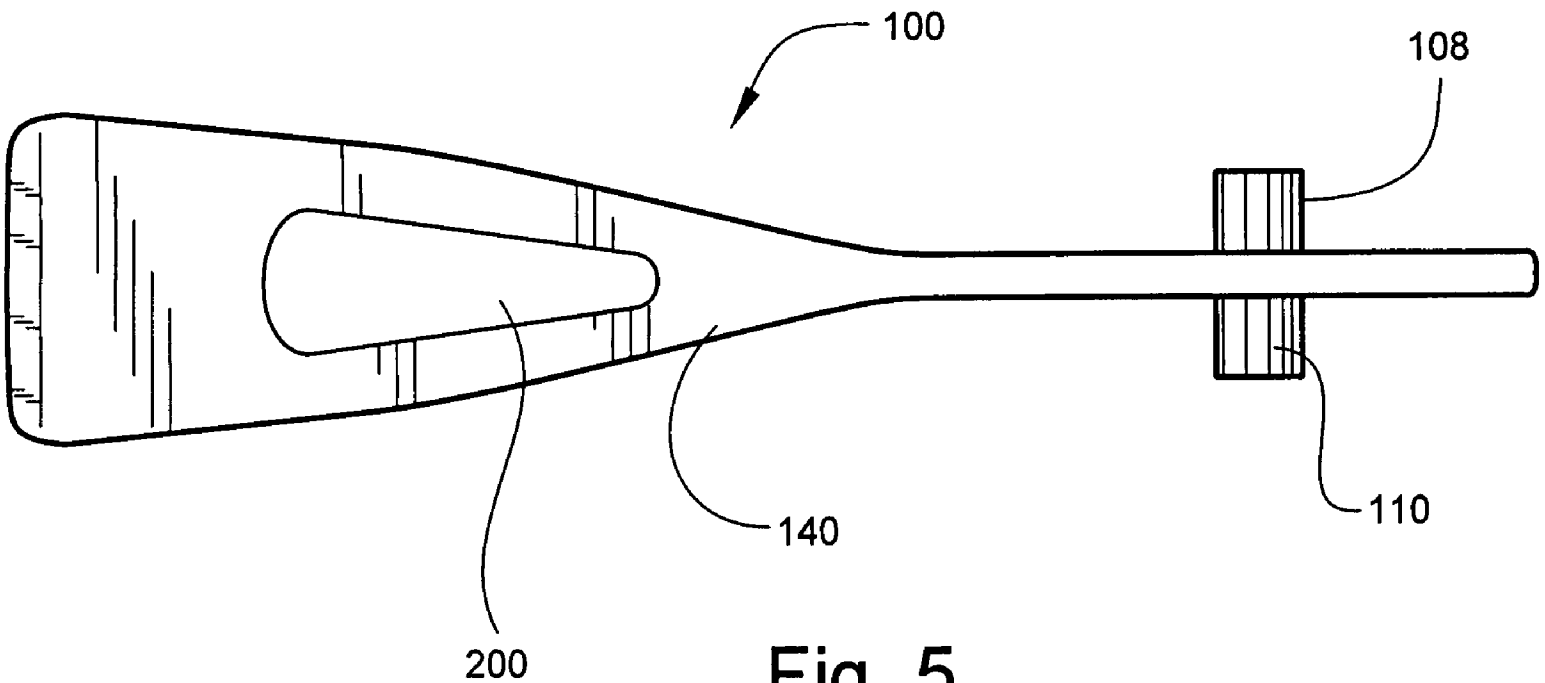
FIG. 5 is an end view of the roofing hatchet of the present invention showing the handle attachment aperture.

Now referring more specifically to FIGS. 1 and 2, head 100 has a first, striking end and a second, bitted end. The exact shape of head 100 may vary, therefore, only a general description of that shape will be set forth. In a preferred embodiment of the present invention, the striking end of head 100 has a substantially square, blunt striking face 102, typical of a standard hatchet head. The bitted end of head 100 is shaped typically of a standard hatchet, being elongated from the junction of handle 200 tapering to a rounded, but relatively thin bit 104 at its lower edge and end. Bit 104 need not have a sharp edge, as its intended purpose is not cutting, but rather providing a thin face to slide under a course of shingle and splitting wooden shake type shingles.

Proximate the second, bitted end of head 100 are three apertures 106 equally spaced one from the other and equidistant from an upper edge of head 100. A threaded bolt 108 having a substantially cylindrical, milled head passes through a selected one of the apertures 106 and mates with a substantially cylindrical, milled nut 110. The head of threaded bolt 108 or nut 110 engages a lower edge of a course of shingles to act as a gauge to measure the overlap of subsequent courses, as well as laterally aligning shingles of subsequent courses to uniformly space the notches between the shingle tabs, as is common in the roofing trade.

In what is defined as the right side of the head 100 in FIG. 2, a cutting blade housing 112 is formed. Cutting blade housing 112 consists of a substantially rectangular depression formed in the side of head 100. The depression of cutting blade housing 112 is formed such that its length is substantially perpendicular to handle 200, with one of its ends being opened to the second, bitted end of head 100. Unlike cutting blade housings of prior art roofing hatchets, the cutting blade housing 112 of the present invention is adapted to receive substantially any commercially available utility blade 114, of a variety of sizes. Prior art hatchets typically are adapted to receive a specific utility blade. A pair of threaded apertures 116, a first proximate an upper edge of cutting blade housing 112 and a second proximate a lower edge of cutting blade housing 112 receive threaded bolts 118 such that the heads of threaded bolts 118 secure utility blade 114 within cutting blade housing 112. Utility blade 114 may, selectively, be extended beyond the second, bitted end of head 100 such that its cutting edge may be manually exposed to a desired depth, or safely stored within the recess of cutting blade housing 112.

Proximate the second, closed end of cutting blade housing 112, a "V" shaped notch 120 is formed in the lower edge of the second, bitted end of head 100. Notch 120 is adapted to engage the head of a nail, or other fastener, for pulling such fasteners from a surface into which it has been driven.

Figure 6:
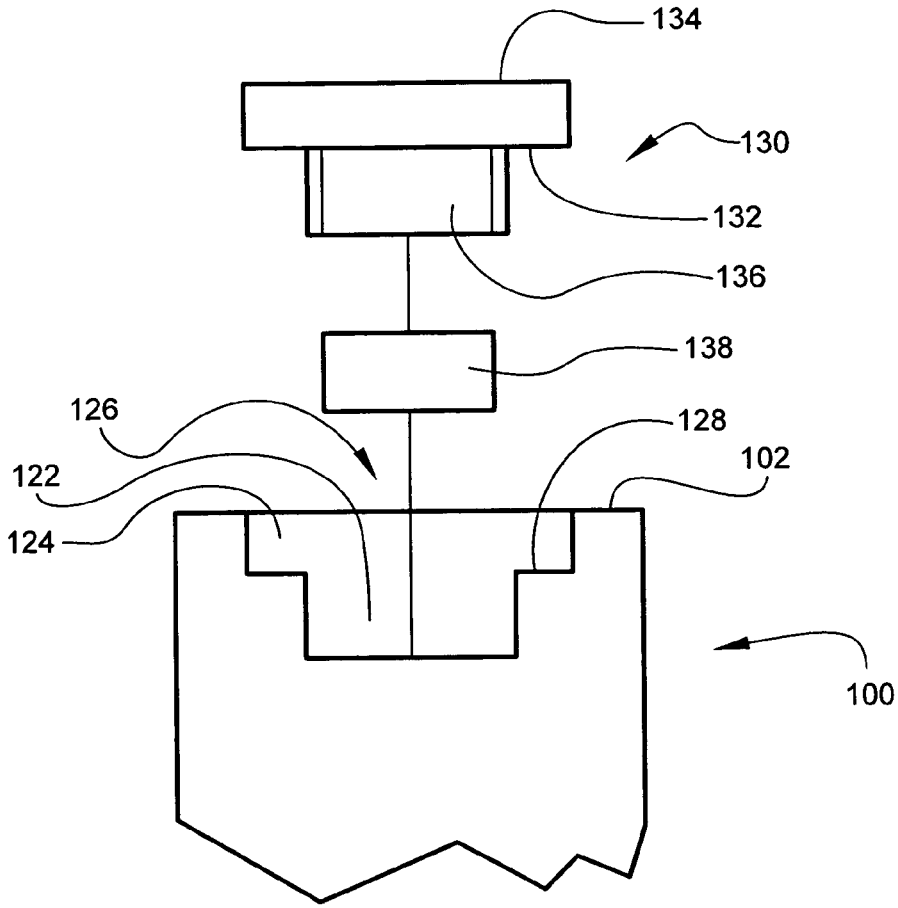
FIG. 6 is a cross sectional view of the striking face of the roofing hatchet of the present invention detailing the magnetic head of the hatchet.

As illustrated at FIG. 6, a substantially cylindrical bore 122 having a first diameter, is bored, cast, or forged into head 100 from and substantially normal to striking face 102. A second, substantially cylindrical bore 124 having a diameter greater than that of bore 122 and an axis coinciding with that of bore 122 is bored into head 100 from striking face 102 such that bore 124 extends into head 100 for a distance less than that of bore 122, thereby forming a shouldered bore 126, having a shoulder 128, open to striking face 102.

Figure 7:
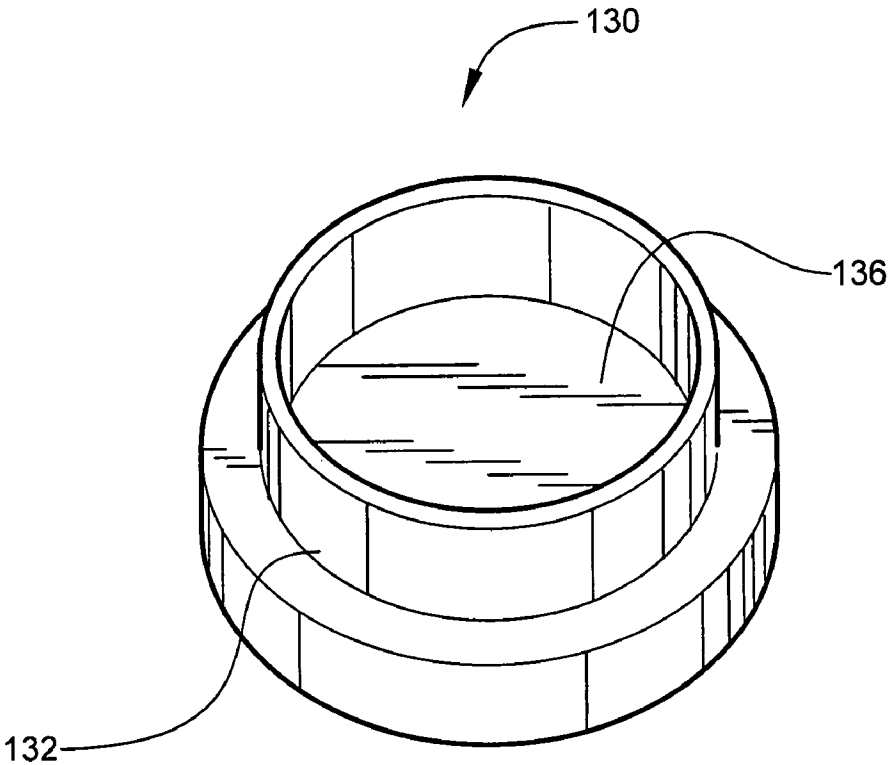
FIG. 7 is a bottom perspective view of the magnet-retaining cap of the roofing hatchet of the present invention.

A cap 130 (FIGS. 6 & 7) is shaped and dimensioned to frictionally fit within shouldered bore 126 such that its shoulder 132 abuts shoulder 128 of shouldered bore 126 and an upper surface 134 of cap 128, having the greater diameter, is substantially flush with striking face 102. The interior of cap 130 consists of a substantially cylindrical bore 136 having a diameter less than that of bore 122 and an axis coinciding with that of cap 130, extending from a lower face of cap 130 to a point substantially coinciding with the plane of the shoulder 132.

Figure 8:
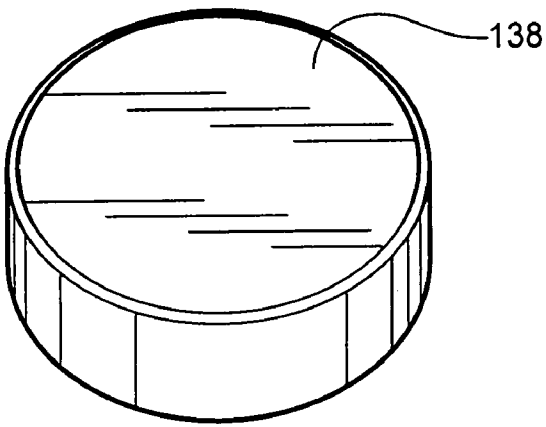
FIG. 8 is a perspective view of the magnet of the roofing hatchet of the present invention.

A substantially cylindrical ferromagnetic disk 138 (FIG. 8), is dimensioned to frictionally fit within cylindrical bore 136 of cap 130, occupying substantially the full depth of bore 136. Ferromagnetic disk 138 is magnetized along its cylindrical axis, thereby automatically centering a nail head on the striking face.

The assembly of ferromagnetic disk 138 within bore 136 of cap 130 is frictionally fit within shouldered bore 126 such that the shoulder 132 of cap 130 rests firmly against the shoulder 128 of shouldered bore 126. Through this configuration, when cap 130 receives the blow of striking a fastener, the greater part of the force is transferred from shoulder 132 to shoulder 128, dissipating the force to ferromagnetic disk 138. Since repeated striking in a single direction tends to demagnetize a magnet, reducing the force of strikes to ferromagnetic disk 138 aids in preserving the magnetic field of ferromagnetic disk 13.

An aperture 140 having an anti-rotational shape, extends through head 100 such to receive a first end of handle 200. Handle 200 is a commercially available handle, as are normal to hatchets, and may be formed of a variety of materials, including, but certainly not limited to, a wood, a polycarbonate, and fiberglass. Handle 200 is attached to head 100 at a determined angle ∠a, ∠a optimizing the force transfer from the hand of a user to a fastener being driven into a sloped surface. Handle 200 may be secured to head 100 by means of a wedge inserted into the end thereof, or by a glue.

It would be evident to one skilled in the art that the above referenced hatchet could be easily modified to other applications, such as, but not limited to dry wall installation.

It is to be understood that the present invention is not limited to the embodiments described above, but encompasses any and all embodiments within the scope of the following claims.

What is claimed is:

1. A roofing hatchet comprising:

a head having a first, striking end and a second, bitted end, said head further comprising:

striking means for driving a fastener into a surface, said striking means comprising a striking face at sais first end of said head;

holding means for holding a fastener on said striking means in preparation for driving a fastener into a surface, said holding means comprising a magnet imbedded within said head at said striking face, wherein said holding means further comprises:

a shouldered bore formed within said head at said striking face, said shouldered bore comprising:

a first bore having an axis substantially normal to said striking face, a first diameter and a first depth, and a second bore having an axis coinciding with said axis of said first bore, a second diameter said second diameter being greater than said first diameter, and a depth, said second depth being less than said first depth, the difference in said first and second diameters forming a shoulder within said shouldered bore;

a cap, said cap dimensioned and configured to forceably and frictionally fit within said shouldered bore such that:

a first end, having a diameter substantially equal to said diameter of said second bore of said shouldered bore, is substantially flush with said striking face of said head, and a second end, having a diameter substantially equal to said diameter of said first bore of said shouldered bore, abuts a bottom of said first bore of said shouldered bore, said second end having an internal bore having a diameter less than said diameter of said second end and a depth, said diameter and said depth being substantially equal to a diameter and a height of said magnet;

said magnet matingly fitting within said bore of said cap and said cap matingly fitting within said shouldered bore such that said shoulder of said cap abuts said should of said shouldered bore and said second end of said cap abuts a bottom of said first bore of said shouldered bore;

gauging means for gauging a distance from said bitted end, cutting means for cutting roofing material;

pulling means for pulling a fastener from a surface;

securing means for attaching a handle to said head; and a handle.

2. A roofing hatchet, as defined in claim 1, wherein said magnet is magnetized along a cylindrical axis such that fasteners attracted by said magnet will automatically center on said axis of said magnet.

3. A roofing hatchet, as defined in claim 1 wherein said gauging means comprises:

at least one aperture, a first of said at least one aperture being spaced at a predetermined distance from said second end of said head and each subsequent of said at least one aperture being spaced at a distance from a prior one of said at least one aperture along a line substantially normal to said second, bitted end of said head; and a threaded bolt having a head and an internally threaded, nut, said head of said bolt and said nut acting as a stop for gauging a distance from said second, bitted end of said head.

4. A roofing hatchet, as defined in claim 1, wherein said pulling means comprises a "V" shaped notch formed in a lower edge of said second, bitted end of said head, said notch adapted to receive a shank of a fastener embedded in a surface such that a head of said fastener is held above said "V" shaped notch, thereby facilitating pulling said fastener from said surface.

5. A roofing hatchet, as defined in claim 1, wherein said securing means comprises:

an anti-rotational aperture formed through said head proximate said striking face, said aperture formed at a predetermined angle relative to said striking face to receive a handle such that said handle optimizes the force transfer from the hand of a user to a fastener being driven into a sloping surface.

6. A roofing hatchet, as defined in claim 5, wherein said handle is formed of at least one material from the group of: wood, a polycarbonate, and fiberglass.

7. A roofing hatchet, comprising:

a head having a first, striking end and a second, bitted end, said head further comprising:

striking means for driving a fastener into a surface, said striking means comprising a striking face at sais first end of said head;

holding means for holding a fastener on said striking means in preparation for driving a fastener into a surface, gauging means for gauging a distance from said bitted end, cutting means for cutting roofing material;

pulling means for pulling a fastener from a surface;

securing means for attaching a handle to said head; and a handle, wherein said cutting means comprises a blade housing, said blade housing comprising:

a substantially rectangular depression in one face of said second, bitted end of said head, a first end of said depression open to said bitted end, said depression sized and configured to adjustably receive a utility knife blade, and at least one threaded aperture proximate said depression, at least one of said at least one threaded aperture threadably receiving a threaded bolt, each of said threaded bolt having a head having a diameter greater than a diameter of said threaded aperture, said head of said at least one threaded bolt adjustably retaining a utility knife blade in said blade housing.

8. A roofing hatchet as defined in claim 7, wherein an exposed face of said utility knife blade lies flush with the face of said second, bitted end of said head in which said depression is formed, and said head of said at least one threaded bolt contacting both the utility knife blade and said face of said second bitted end of said head in which said depression is formed.

9. A roofing hatchet comprising:

a head having a first, striking end and a second, bitted end, said head further comprising:

striking means for driving a fastener into a surface, said striking means comprising a striking face at said first end of said head;

holding means for holding a fastener on said striking face, said holding means comprising a magnet imbedded therein, said magnet magnetized along a cylindrical axis such that fasteners attracted by said magnet will automatically center on said axis of said magnet;

gauging means for gauging a distance from said bitted end, said gauging means comprising:

at least one aperture, a first of said at least one aperture space at a determined from said second, bitted end of said head and each subsequent of said at least on e aperture space at a determined distance from a prior one of said at least one aperture along a line substantially normal said second bitted end of said head, and a threaded bolt having a substantially cylindrical head and an internally threaded, substantially cylindrical nut, said head of said bolt and said nut acting as a stop for gauging a distance from said second, bitted end of said head;

cutting means for cutting roofing materials, said cutting means comprising:

a substantially rectangular depression in one face of said second bitted end of said head, a first end of said depression open to said bitted end, said depression sized and configured to adjustably receive a utility knife blade and forming a blade housing, at least one threaded aperture proximate said depression, at least one of said at least one threaded aperture threadably receiving a threaded bolt, each of said threaded bolt having a head having a diameter greater than a diameter of said threaded aperture, and a utility knife adjustably retained in said blade housing by said head of said at least one threaded bolt;

pulling means for pulling a fastener from a surface, said pulling means comprising a "V" shaped notch formed in a lower edge of said second, bitted end of said head, said notch adapted to receive a shank of a fastener embedded in a surface such that a head of said fastener is held above said "V" shaped notch, thereby facilitating pulling said fastener from said surface; and a handle secured to said headsy s predetermined angle such that said handle optimizes the force transfer from the hand of a user to a fastener being driven into a sloping surface.

* * * * *